US009437991B2

(12) United States Patent
Salas Zamarripa et al.

(10) Patent No.: US 9,437,991 B2
(45) Date of Patent: Sep. 6, 2016

(54) LOAD CENTER BUS HAVING INTEGRAL STABS WITH FORMED SHAPES

(71) Applicant: SCHNEIDER ELECTRIC USA, INC., Palatine, IL (US)

(72) Inventors: Ezequiel Salas Zamarripa, Apodaca (MX); Mauricio Diaz, San Nicolas de los Garza (MX)

(73) Assignee: Schneider Electric USA, Inc., Andover, MA (US)

( * ) Notice: Subject to any disclaimer, the term of this patent is extended or adjusted under 35 U.S.C. 154(b) by 14 days.

(21) Appl. No.: 14/328,076

(22) Filed: Jul. 10, 2014

(65) Prior Publication Data

US 2016/0013600 A1 Jan. 14, 2016

(51) Int. Cl.

| | |
|---|---|
| ***H01R 43/16*** | (2006.01) |
| ***H01R 25/16*** | (2006.01) |
| ***B21D 28/08*** | (2006.01) |
| ***B21D 35/00*** | (2006.01) |

(52) U.S. Cl.

CPC ..... *H01R 25/162* (2013.01); *B21D 28/08* (2013.01); *B21D 35/003* (2013.01); *H01R 43/16* (2013.01)

(58) Field of Classification Search

CPC .... H01R 25/145; H01R 13/02; H01R 25/14; H01R 4/00

See application file for complete search history.

(56) References Cited

U.S. PATENT DOCUMENTS

| | | | | |
|---|---|---|---|---|
| 4,002,388 | A | 1/1977 | Menocal | |
| 4,153,318 | A | 5/1979 | Bishop et al. | |
| 4,198,107 | A | 4/1980 | Luke et al. | |
| 6,174,208 | B1 * | 1/2001 | Chen | H01R 13/113 439/752.5 |
| 6,813,142 | B1 * | 11/2004 | Seff | H02B 1/056 361/637 |
| 7,580,247 | B1 * | 8/2009 | Pearson | H02B 1/056 174/149 B |
| 7,581,977 | B1 * | 9/2009 | Wu | H01R 13/7036 439/106 |
| 2002/0028612 | A1 * | 3/2002 | Ushijima | H01R 4/187 439/879 |
| 2009/0042444 | A1 * | 2/2009 | Shimizu | H05K 5/0091 439/620.21 |
| 2012/0083171 | A1 * | 4/2012 | Byrne | H01R 11/22 439/888 |
| 2012/0100731 | A1 * | 4/2012 | Umemoto | H01R 13/113 439/86 |
| 2014/0287604 | A1 * | 9/2014 | Lin | H01R 12/57 439/83 |

OTHER PUBLICATIONS

NEHB Panelboards Main Lugs and Main Circuit Breaker Replacement Parts. pp. 1-8, Jun. 2000 (Replaces 1660SB9201 dated Jul. 1992).

* cited by examiner

*Primary Examiner* — Truc Nguyen
(74) *Attorney, Agent, or Firm* — Locke Lord LLP

(57) ABSTRACT

A bus system for a load center includes a bus bar having a plurality of integrated bus stabs and has superior thermal characteristics for the amount of conductive material used. The bus bar and the bus stabs are formed as a unitary piece from a single sheet of conductive material. Each bus stab includes a folded portion with a plug-on section to receive a connector from a circuit breaker. The folded portion is formed with two opposing edges from flanges of the integrated bus stab which are folded and configured to be engaged by the connector, and forms a central channel, typically with a substantially U-shaped cross section. The folded portion further has a tapered folded section between the bus bar and the plug-on section. The bus system can be manufactured by cutting out the unitary piece with the bus bar and integrated bus stabs from a sheet of conductive material, and then stamping it to form the folded portion on each bus stab.

15 Claims, 6 Drawing Sheets

800

TABLE A (225 AMP, 42 CIRCUIT LOAD CENTER)

| CASE | | 1 | 2 | 3 | UL Limit |
|---|---|---|---|---|---|
| Thickness of blank | | 0.1" | 0.08" | 0.0625" Folded | |
| Cu savings | | 20% | 36% | 50% | |
| Thermocouple Number and Location | | Temperature Rise (K) | | | |
| 1 | Main Line Lug Left | 36.2 | 38.0 | 39.5 | 50 |
| 2 | Main Line Lug Right | 36.5 | 38.3 | 40.1 | 50 |
| 5–1 | Plug on Stab 1 (middle) | 56.4 | 63.4 | 62.5 | 65 |
| 6–1 | Plug on Stab 2 (middle) | 55.6 | 62.6 | 63.7 | 65 |

FIG. 8

LOAD CENTER BUS HAVING INTEGRAL STABS WITH FORMED SHAPES

FIELD

The present disclosure relates to the field of bus systems for electrical enclosures such as a load center, and more particularly, to a bus bar with integrated bus stabs to receive a plug-on type connector from a circuit breaker.

BACKGROUND

Electrical enclosures, such as load centers, house circuit breakers which provide overcurrent protection in the distribution of power to branch circuits. A load center includes a bus system, which is formed of conductors that are connected to a single or multi-phase power source to supply power to branch circuits and their downstream load devices. The bus system includes conductive bus bars. Each bus bar typically has multiple conductive bus stabs. The bus stabs may be connected to the bus bar using fasteners, such as bolts or screws. The bus stabs are configured to receive a circuit breaker connector in order to provide interconnection of a circuit breaker to the bus bar.

When current is supplied through the conductors of the bus system to the downstream devices, heat is generated on the current carrying conductors of the bus system, particularly at the connection or fastening points such as between a bus bar and a bus stab. To satisfy thermal requirements set forth by industry regulations and standards, the bus bars and bus stabs are designed with sufficient size and thickness (e.g., oversized) to enable sufficient thermal dissipation in order to control conductor temperature below a maximum allowed temperature during operation. However, the bus bars and bus stabs are typically made of costly conductive materials or metals, such as copper. Thus, the use of more conductive material in the design of the bus system increases the overall costs of a load center.

Accordingly, there is a need to provide an improved bus system for a load center, which utilizes less conductive materials, while still satisfying thermal and electrical requirements for a load center.

SUMMARY

An improved bus system for a load center is disclosed which includes a bus bar with integrated folded bus stabs. The bus bar and bus stabs are cut out (e.g., punched out) as a unitary piece from a single sheet of conductive material. The unitary piece of conductive material is stamped to provide a folded portion on each bus stab of the bus bar. The folded portion has a tapered folded section with nonparallel edges, and a plug-on section with substantially parallel edges. For example, the folded portion is formed from two opposing folded edges, which may have an angled or rolled shape. Each folded edge has a flange extending therefrom. In the tapered folded section, the pair of flanges have their edges arranged in a nonparallel fashion. In the plug-on section, the edges of the pair of flanges remain substantially parallel with each other and create a section to receive a plug-on connector, such as from a circuit breaker. The folded portion can have a substantially U-shape or tubular cross-sectional area perpendicular to a longitudinal axis of the bus stab, with a central channel extending therethrough. The bus system reduces heat generation by eliminating the need for fasteners, such as bolts and screws, to connect the bus stabs to the bus bar.

Furthermore, the folded portions of the bus stabs are designed to provide greater surface area (than straight bus stabs), which allows for improved physical and electrical engagement of a circuit breaker connector thereon as well as improved thermal dissipation during operation. Accordingly, the bus system can be manufactured using less conductive materials, e.g., the bus bar and bus stabs may be thinner than conventional bus bars with bolted-on bus stabs, while still satisfying thermal and electrical requirements. For example, a bus bar with integrated bus stabs may be designed with a thickness of 0.1 inches or less (e.g., from 0.1 to 0.0625 inches) for a panelboard or residential load center, with temperature rise characteristics that satisfy industry standards.

Each integrated bus stab also includes a transition portion connected between the bus bar and the folded portion of the bus stab. The transition portion of each bus stab may be stamped to bend the transition portion so that the folded portion of the bus stab is offset from the level of the bus bar on the bus system. For example, the folded portion can be offset at a higher or elevated position than the bus bar on the bus system.

BRIEF DESCRIPTION OF THE DRAWINGS

The description of the various exemplary embodiments is explained in conjunction with the appended drawings, in which:

FIG. 8 is a table showing exemplary experimental data of temperature rise characteristics of a straight-type integrated bus stab and a folded-type integrated bus stab in comparison to industry standards.

DETAILED DESCRIPTION

Figure 1:
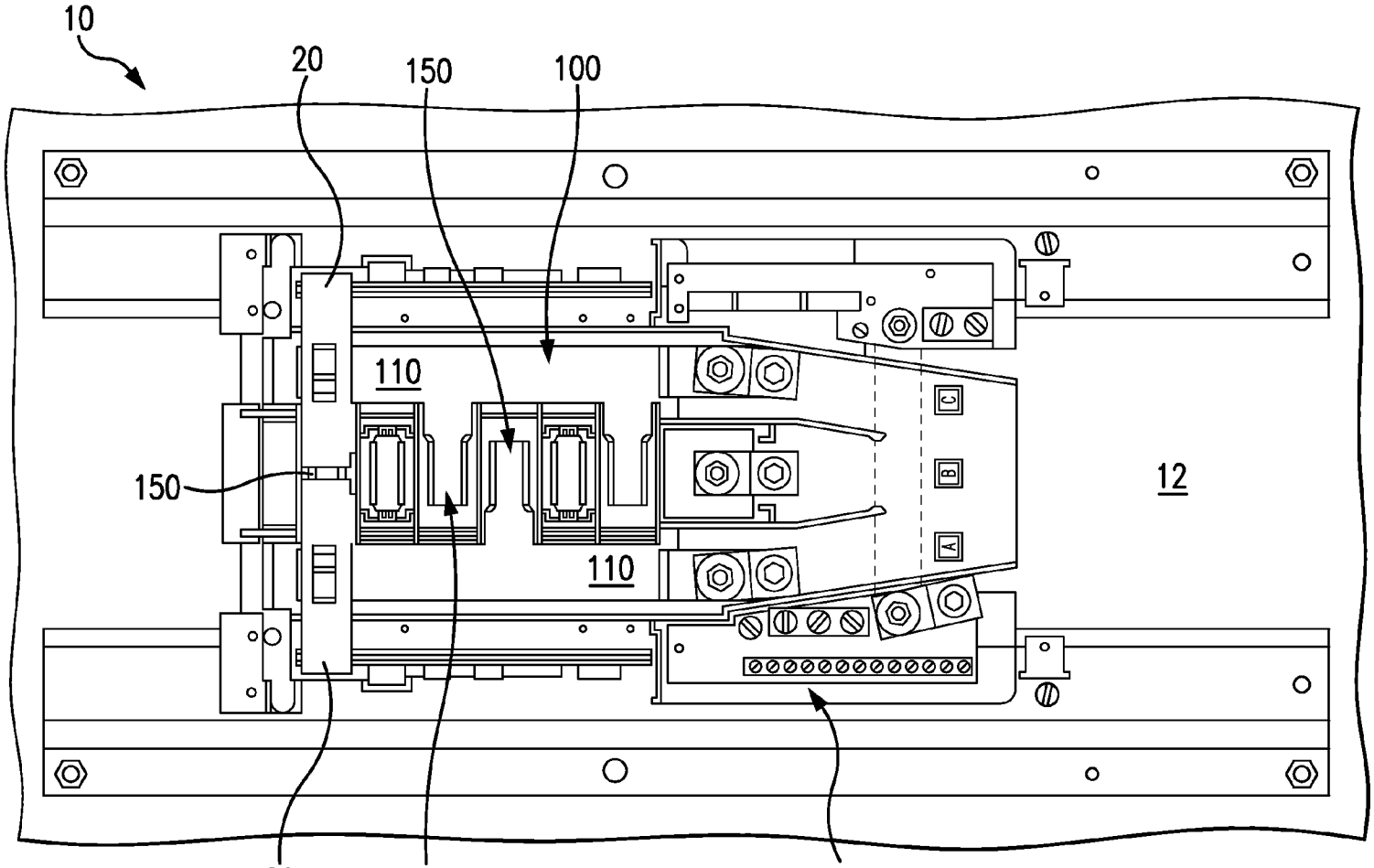
FIG. 1 illustrates a front view of an electrical enclosure, such as a panelboard or residential load center, with a bus system that includes a bus bar with integrated bus stabs in accordance with an embodiment of the present disclosure.

Referring to FIG. 1, a front view is shown of an interior of an electrical enclosure 10, such as a panelboard or residential load center. The electrical enclosure 10 includes a housing 12, which has installed therein a bus system 100 to distribute power from a power supply to one or more branch circuits. The bus system 100 is centrally located in the electrical enclosure 10, which also includes neutral bus bar 14. The bus system 100 includes conductors, such as a bus bar 110 with a plurality of integrated bus stabs 150 on which to receive a plug-on type connector (e.g., a clip) from one or more circuit breakers 20. For example, the connectors of two circuit breakers 20 on opposite sides of the electrical enclosure 10 can both be connected onto the same bus stab 150, as shown. In FIG. 1, the bus bar 110 and the bus stabs 150 of the bus system 100 are formed as a unitary piece, such as from a sheet of conductive material. Accordingly, there is no need to use fasteners to connect individual bus stabs to a bus bar, which reduces heat generation that would otherwise occur at fastening joints between the conductive components and across the bus system 100.

Figure 3:
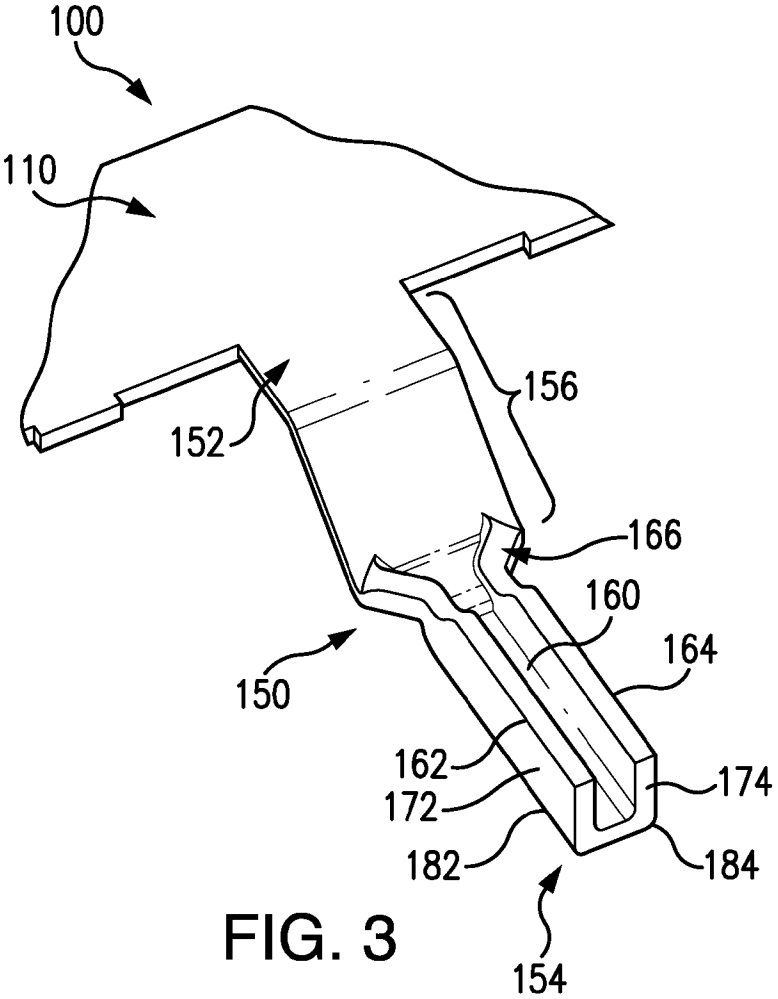
FIG. 3 illustrates a partial bottom view of a portion of the bus system of FIG. 1.
Figure 2:
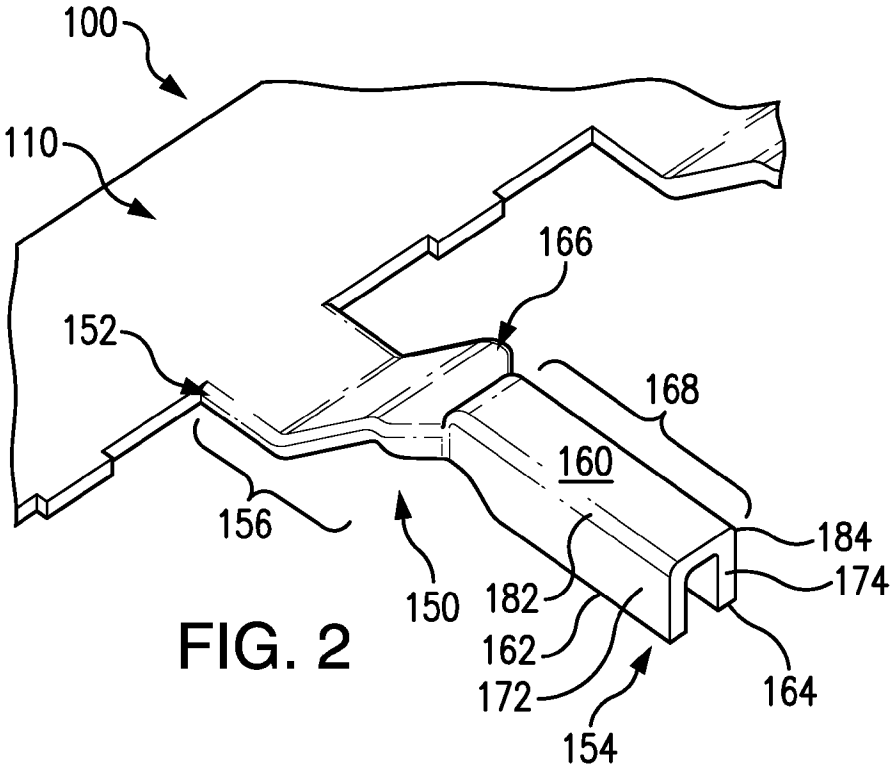
FIG. 2 illustrates a partial top view of a portion of the bus system of FIG. 1.

As shown in FIGS. 2 and 3, the bus stab 150 is an elongated component, which extends perpendicularly from one side of the bus bar 110. The bus stab 150 has a first end 152 connected to the bus bar 110, and a second end 154 opposite the first end 152. The second end 154 is a free end.

The bus stab 150 includes two portions, namely a transition portion 156 and a folded portion 160. The transition portion 156 is connected between the bus bar 110 and the folded portion 160 of the bus stab 150. The transition portion 156 is bent or folded at different locations along its length so that the folded portion 160 of the bus stab 150 is offset from the level of the bus bar 110 on the bus system 100. In this example, the folded portion 160 is offset at a higher or elevated position than the bus bar 110.

The folded portion 160 includes a tapered folded section 166, and a parallel folded section 168 which is also referred to as a "plug-on section" 168. The plug-on section 168 receives a plug-on type connector (e.g., a clip) from an electrical device, such as a circuit breaker. The folded portion 160 is folded to form two opposing folded edges 182 and 184 with flanges 172 and 174, respectively, extending therefrom. Each folded edge 182 or 184 may take any form of a rolled or angled edge. The flanges 172 and 174 have edges 162 and 164, respectively, which oppose each other (also referred to as "opposing edges" 162 and 164) and run along a length of the folded portion 160. In this example, the opposing edges 162 and 164 are nonparallel to each other along the tapered folded section 166, and are substantially parallel to each other along the plug-on section 168, The folded tapered section 166 tapers inwardly via nonparallel folding of the first and second opposing edges 162 and 164 in a direction from the first end 152 towards the second end 154 until the opposing edges 162 and 164 become parallel to each other along the plug-on section 168. The plug-on section 168 may be offset from the level of the tapered folded section 166 of the folded portion 160. For example, the plug-on section 168 may be offset at a slightly higher or elevated position than the tapered folded section 166.

Figure 4:
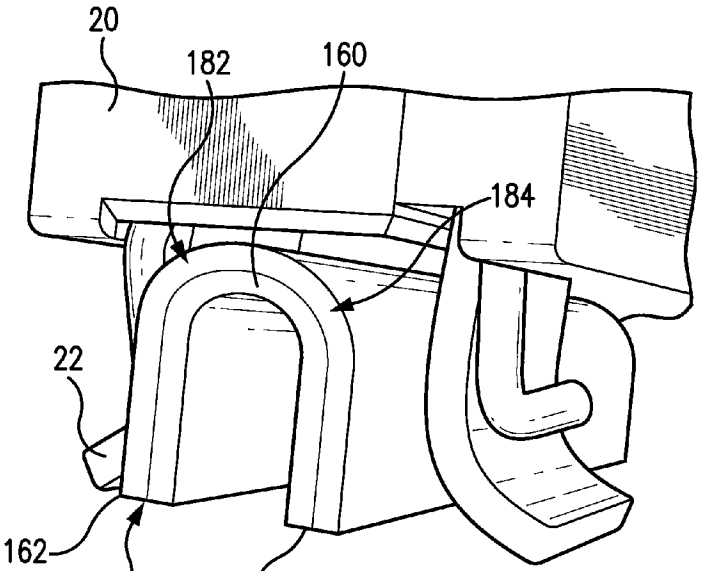
FIG. 4 illustrates an end view of an integrated bus stab of FIG. 1 having a circuit breaker connector engaged thereon.
Figure 5:
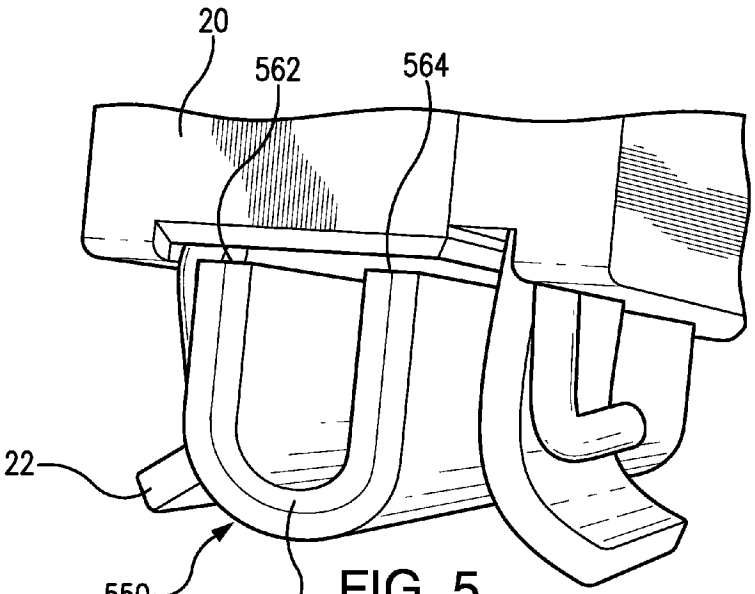
FIG. 5 illustrates an end view of another embodiment of an integrated bus stab of a bus system, with a circuit breaker connector engaged thereon.

FIG. 4 illustrates an end view of the bus stab 150. As shown, the folded edges 182 and 184 of the bus stab 150 create a U-shape cross-sectional area perpendicular to a longitudinal axis of the bus stab 150, which provides greater surface area on which to receive a plug-on type connector 22 (e.g., a clip) of a circuit breaker 20. An example of another U-shape type bus stab 550, which is integrated with a bus bar, is shown in FIG. 5 in accordance with a further embodiment of the present disclosure. In FIG. 5, the bus stab 550 also includes a folded portion, e.g., a folded portion 560 with opposing edges 562 and 564. However, the folded portion 560 of the bus stab 550 of FIG. 5 has a reverse or inverted U-shape cross-sectional orientation with the open portion of the "U" facing the circuit breaker 20 rather than the folded or closed portion 160 of the "U" of the bus stab 150 facing the circuit breaker 20 as in FIG. 4. Instead of a U-shape configuration as shown in FIGS. 4 and 5, the bus stab can be formed with a tubular cross-sectional area if opposing edges, e.g., the edges 162 and 164 (in FIG. 4) or the edges 562 and 564 (in FIG. 5), are rolled together to close the open portion of the "U".

Figure 6:
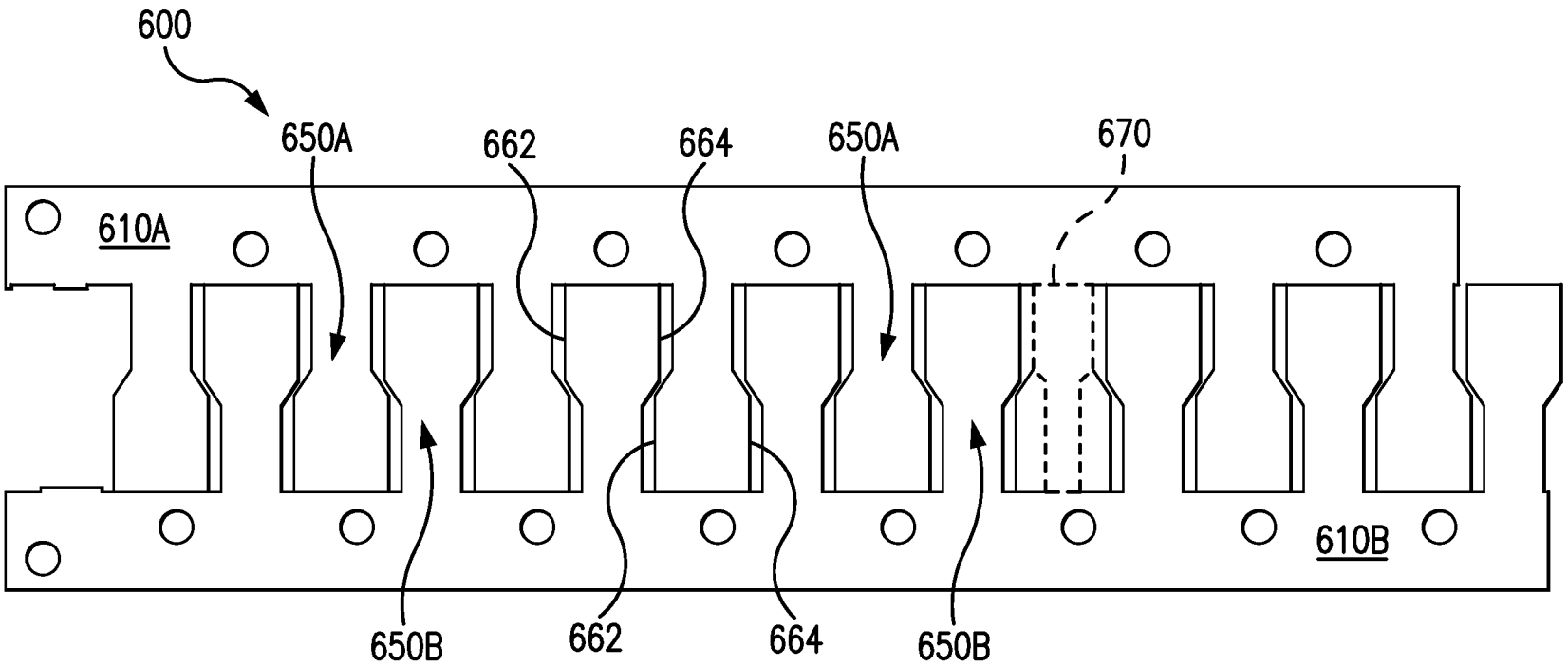
FIG. 6 illustrates an exemplary blank of integrated components of a bus system, which are cut out from a sheet of conductive material as an unitary piece in accordance with an embodiment of the present disclosure.

FIG. 6 illustrates an example of a blank 600 of a bus system(s), which is cut out (e.g., punched out) from a sheet of conductive material. The blank 600 may be used as part of the process to manufacture an improved bus system, such as described herein. In this example, the blank 600 is initially cut out with two bus bars 610A and 610B each having integrated bus stabs 650A and 650B (both generally referred to as "650"), respectively. Each bus stab 650 is cut out with opposing wing portions 662 and 664. The wing portions 662 and 664 are stamped to fold them into a folded portion, such as the folded portion 160 (in FIGS. 2 and 3) with flanges 172 and 174 and folded edges 182 and 184. The folded bus stab 650 can be cut out from a sheet of conductive material in a similar fashion as a straight bus stab. For example, the wing portions 662 and 664 of the folded bus stab 650 can be cut out from an area on a single sheet of conductive material, which may be unused or scrapped when cutting out a blank for a bus system with straight integrated bus stabs. An outline of a straight bus stab is shown by the dotted lines 670 in comparison to the wing portions 662 and 664 for a folded bus stab 650.

Figure 7:
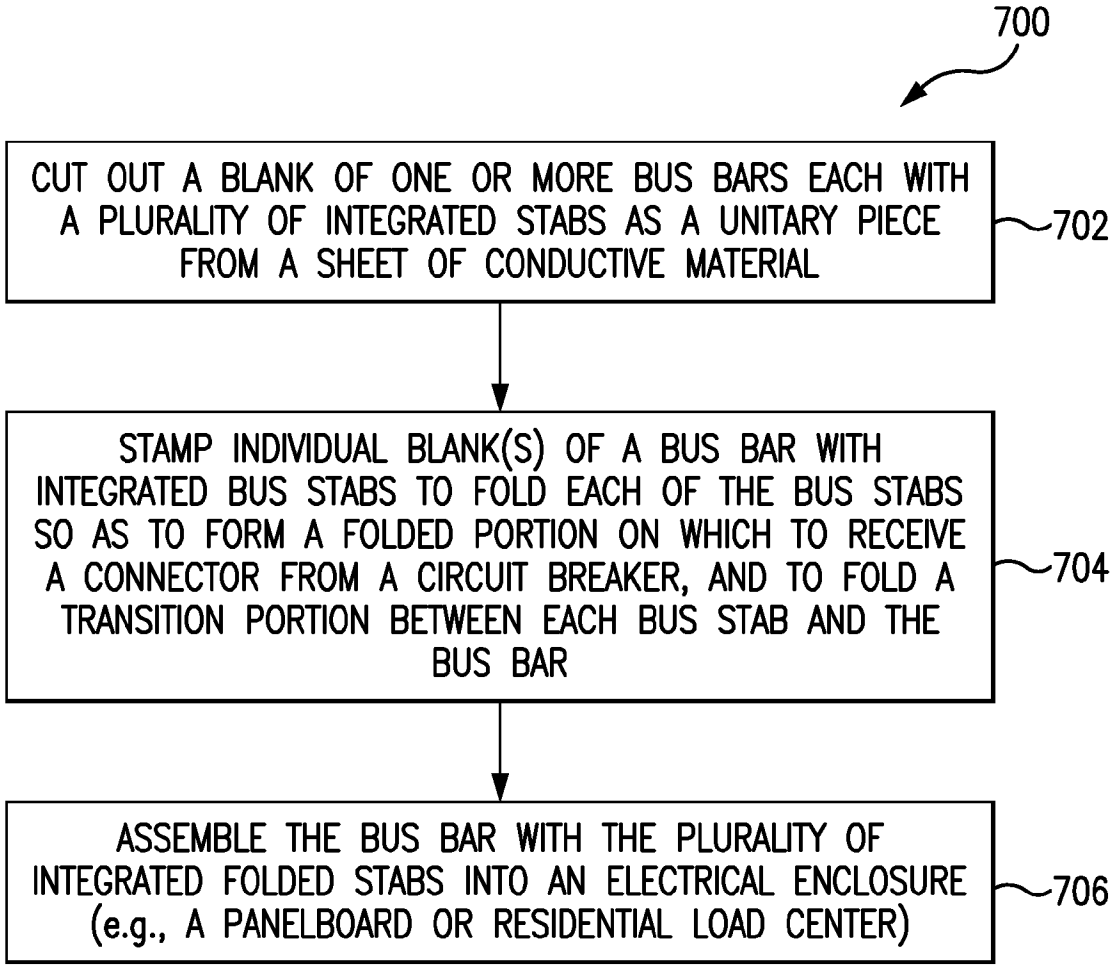
FIG. 7 illustrates a flow diagram of an exemplary process by which to manufacture a bus system such as in FIG. 1.

FIG. 7 illustrates an example process 700 by which to manufacture a bus system, such as the bus system 100 for the electrical enclosure 10 in FIG. 1. The process 700 includes cutting out a blank of one or more bus bars with a plurality of integrated stabs as a unitary piece from a single sheet of conductive material, at a reference 702. An example of a cutout blank, e.g., 600, is shown in FIG. 6. If multiple bus bars are cut out together, the bus bars are subsequently separated from each other to form cutout blanks of individual bus bars each with integrated bus stabs. The cut out operation may be performed using a suitable metal punching and/or cutting machine.

At reference 704, the cutout blank of the individual bus bar with integrated bus stabs is then stamped to bend or fold each of the blank stabs to form a tapered folded section 166 which leads to a parallel folded portion such as a plug-on section 168 on which to receive a plug-on connector from a circuit breaker. For example, the edges 162 and 164 of a portion of each bus stab is bent toward each other to form a folded portion 160 with folded edges 182 and 184. The folded portion 160 is formed with a tapered folded section 166 and a plug-on section 168. The folded portion 160 may have a substantially U-shape or tubular cross-sectional area perpendicular to a longitudinal axis of the bus stab.

Furthermore, the stab can also be stamped to bend a transition portion (e.g., the transition portion 156) of each bus stab so that the folded portion (e.g., the folded portion 160) of the stab is at an offset, higher, position than the bus bar on the bus system. The process 700 may involve one or more stamping/bending operations to shape the folded portion, and the transition portion if desired, of the integrated bus stabs of the bus system. The stamping operation(s) may be performed using any suitable metal stamping and/or bending machines, forms or dies.

At reference 706, the stamped bus bar with integrated bus stabs is assembled into an electrical enclosure, e.g., a panelboard or residential load center, such as in FIG. 1.

The bus system 100, as described above, reduces heat generation through the unitary design of the bus bar and bus stabs, which eliminates the need for fastening joints. The bus system also incorporates folded bus stabs, which provide better ventilation and heat dissipation (than straight bus stabs). In this way, the bus stabs 150 of the bus system 100 provide for improved physical and electrical engagement of a circuit breaker connector thereon as well as improved thermal dissipation during operation. Accordingly, the improved design of the bus system 100 can be manufactured using less conductive materials, e.g., the bus bar and bus stabs may be thinner than conventional bus bars with bolted-on bus stabs, while still satisfying thermal and electrical requirements.

FIG. 8 is a chart 800 of Table A, which shows experimental data of temperature rise characteristics for a straight-type integrated bus stab and a folded-type integrated bus stab in relation to industry standards at varying thicknesses. In the experiment, the bus stabs were tested for a 225 Amp, 42 Circuit Load Center, and made of copper (Cu). In Table A, Cases 1 and 2 show resulting temperature rise data for a straight-type integrated bus stab having thicknesses of 0.125 and 0.100 inches, respectively. Case 3 shows temperature rise data for a folded-type integrated bus stab having a thickness of 0.625.

As shown in Table A, the folded bus stab can be designed and manufactured using 50 percent less conductive material (e.g., copper) than conventional bolt-on bus stabs, while still satisfying the industry requirements for temperature rise characteristic during operation. For example, experiments have shown that the bus system with the integrated folded bus stabs in Case 3 has temperature rise characteristics (1) less than a maximum of 50 Kelvin for a main line lug (e.g., the area of the bus bar connected to or in proximity to a bus stab) and (2) less than a maximum of 65 Kelvin for plug on stab (e.g., a plug-on section of the bus stab that receives a plug-on type connector of a circuit breaker). The folded integrated bus stab in Case 3 also provides greater savings in the use of conductive materials than the integrated straight bus stabs of Cases 1 and 2. Accordingly, a bus bar with fold integrated bus stabs may be designed and manufactured with smaller thicknesses, for example, at a thickness at or less than 0.100 inches (e.g., from 0.1 to 0.0625 inches) for a panelboard or residential load center, while still satisfying requirements for temperature rise characteristics (such as noted above). The thickness of the bus system can be varied according to the electrical application, such as the power requirements (e.g., amperage) for the bus system and the associated electrical enclosure.

The illustrated embodiments of the bus system 100 are simply provided as examples. The size, shape and orientation of the integrated components of the bus system 100 (e.g., the bus bar, and the bus stabs including the first and second ends, the transition portion, the folded portion, the tapered folded section and the plug-on section, etc.) may be varied to accommodate physical and electrical specifications of a load center. The bus system and its components may be molded, punched and/or stamped, and may be formed of a conductive material, such as copper, aluminum or any suitable conductive material or composition of materials depending on the application and the desired electrical specifications.

Furthermore, words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A bus system for a load center comprising:

a bus bar having a plurality of integrated bus stabs, the bus bar and the bus stabs being a unitary piece formed from a sheet of conductive material, each of the plurality of bus stabs including:

a first end connected to the bus bar; and a second end opposite the first end and being a free end, the second end including a folded portion on which to receive a plug-on type connector from a circuit breaker, the folded portion of each bus stab comprising two opposing folded edges to engage a single plug-on type connector, each of the two opposing folded edges being any form of an angled or rolled edge, the folded portion having a tapered section which tapers inwardly in a direction from the first end toward the second end of the bus stab, wherein the sheet of conductive material has a thickness less than or equal to 0.100 inches, and the bus bar and bus stabs have temperature rise characteristics (1) less than 50 Kelvin for an area of the bus bar connected to or in proximity to a bus stab and (2) less than 65 Kelvin for a plug-on section of the folded portion.

2. The bus system of claim 1, wherein the thickness is from 0.1 to 0.0625 inches.

3. The bus system of claim 1, wherein the folded portion of each bus stab has a substantially U-shape cross-sectional area perpendicular to a longitudinal axis of the bus stab.

4. The bus system of claim 1, wherein each bus stab further includes a transition portion connected between the bus bar and the folded portion of the bus stab, the transition portion of each bus stab being bent so that the folded portion of each bus stab is offset from the level of the bus bar.

5. A load center comprising:

a housing; and a bus bar having a plurality of integrated bus stabs, the bus bar and the bus stabs being a unitary piece formed from a sheet of conductive material, each of the plurality of bus stabs including:

a first end connected to the bus bar; and a second end opposite the first end and being a free end, the second end including a folded portion on which to receive a plug-on type connector from a circuit breaker, the folded portion of each bus stab comprising two opposing folded edges to engage a single plug-on type connector, each of the two opposing folded edges being any form of an angled or rolled edge, the folded portion having a tapered folded section which tapers inwardly in a direction from the first end toward the second end of the bus stab, wherein the sheet of conductive material has a thickness less than or equal to 0.100 inches, and the bus bar and bus stabs have temperature rise characteristics (1) less than 50 Kelvin for an area of the bus bar connected to or in proximity to a bus stab and (2) less than 65 Kelvin for a plug-on section of the folded portion.

6. The load center of claim 5, wherein the thickness is from 0.1 to 0.0625 inches.

7. The load center of claim 5, wherein the folded portion of each bus stab has a substantially U-shape cross-sectional area perpendicular to a longitudinal axis of the bus stab.

8. The load center of claim 5, wherein each bus stab further includes a transition portion connected between the bus bar and the folded portion of the bus stab, the transition portion of each bus stab being bent so that the folded portion of each bus stab is offset from the level of the bus bar.

9. A method of manufacturing a bus system for a load center comprising:

cutting out from a sheet of conductive material a unitary piece comprising a bus bar with a plurality of integrated bus stabs; and stamping the unitary piece to form a folded portion on each bus stab to receive a plug-on type connector of a circuit breaker, the folded portion of each bus stab comprising two opposing folded edges to engage the plug-on connector, each of the two opposing folded edges being any form of an angled or rolled edge, wherein the stamping further forms a tapered folded section in the folded portion, the tapered folded section tapering inwardly in a direction from a first end toward a second end of the bus stab, the first end being connected to the bus bar, the second end being opposite the first end and having the folded portion, wherein the cutting out step cuts out each bus stab with a non-folded transition portion connected between the folded portion of the bus stab and the bus bar, the stamping including bending the non-folded transition portion so that the folded portion of each bus stab is offset from the level of the bus bar.

10. The method of claim 9, wherein the cutting out cuts out each bus stab to include two opposing wing portions from the sheet of conductive material, the stamping including bending the wing portions for each bus stab to form the two opposing folded edges, each of the folded opposing edges having a flange extending therefrom.

11. A method of manufacturing a bus system for a load center comprising:

cutting out from a sheet of conductive material a unitary piece comprising a bus bar with a plurality of integrated bus stabs; and stamping the unitary piece to form a folded portion on each bus stab to receive a plug-on type connector of a circuit breaker, the folded portion of each bus stab comprising two opposing folded edges to engage the plug-on connector, each of the two opposing folded edges being any form of an angled or rolled edge, wherein the sheet of conductive material has a thickness of or less than 0.100 inches, and the bus bar and bus stabs have temperature rise characteristics (1) less than 50 Kelvin for an area of the bus bar connected to or in proximity to a bus stab and (2) less than 65 Kelvin for a plug-on section of the folded portion.

12. The method of claim 11, wherein the stamping further forms a tapered folded section in the folded portion, the tapered folded section tapering inwardly in a direction from a first end toward a second end of the bus stab, the first end being connected to the bus bar, the second end being opposite the first end and having the folded portion.

13. The method of claim 12, wherein the cutting out cuts out each bus stab to include two opposing wing portions from the sheet of conductive material, the stamping including bending the wing portions for each bus stab to form the two opposing folded edges, each of the folded opposing edges having a flange extending therefrom.

14. The method of claim 11, wherein the cutting out step cuts out each bus stab with a transition portion connected between the folded portion of the bus stab and the bus bar, the stamping including bending the transition portion so that the folded portion of each bus stab is offset from the level of the bus bar.

15. A bus system for a load center comprising:

a bus bar having a plurality of integrated bus stabs, the bus bar and the bus stabs being a unitary piece formed from a sheet of conductive material, each of the plurality of bus stabs including:

a first end connected to the bus bar; and a second end opposite the first end and being a free end, the second end including a folded portion on which to receive a plug-on type connector from a circuit breaker, the folded portion of each bus stab comprising two opposing folded edges to engage a single plug-on type connector, each of the two opposing folded edges being any form of an angled or rolled edge, the folded portion having a tapered section which tapers inwardly in a direction from the first end toward the second end of the bus stab, wherein each bus stab further includes a non-folded transition portion connected between the bus bar and the folded portion of the bus stab, the non-folded transition portion of each bus stab being bent so that the folded portion of each bus stab is offset from the level of the bus bar.

* * * * *